United States Patent [19]

Hillman

[11] Patent Number: 4,951,588

[45] Date of Patent: Aug. 28, 1990

[54] SAILBOAT MAST DECK SEALING ASSEMBLY

[76] Inventor: Lawrence M. Hillman, 7119 Killdeest St., Long Beach, Calif. 90808

[21] Appl. No.: 353,493

[22] Filed: May 18, 1989

[51] Int. Cl.[5] ..... B63B 15/00

[52] U.S. Cl. ..... 114/93; 277/12

[58] Field of Search ..... 114/89–94, 114/102, 39.1, 127; 440/112; 277/12, 64, 95, 100, 101, 121, 127

[56] References Cited

U.S. PATENT DOCUMENTS

| | | | |
|---|---|---|---|
| 3,076,658 | 2/1963 | Leman | 277/121 |
| 3,348,850 | 10/1967 | Scales | 277/101 |
| 3,352,579 | 11/1967 | Hoke | 277/101 |
| 3,899,183 | 8/1975 | Wild et al. | 277/101 |
| 4,227,700 | 10/1980 | Merry | 114/93 |
| 4,457,517 | 7/1984 | Dunegan | 277/12 |
| 4,548,415 | 10/1985 | Bendl | 277/100 |
| 4,643,439 | 3/1987 | Lewis et al. | 277/95 |
| 4,759,552 | 7/1988 | Schütz | 114/127 |

*Primary Examiner*—Joseph F. Peters, Jr.
*Assistant Examiner*—Jesûs D. Sotelo
*Attorney, Agent, or Firm*—Howard A. Kenyon

[57] ABSTRACT

A sail boat mast deck sealing assembly to provide a watertight seal between the mast and the boat deck is described. The assembly comprises a rigid flange member or collar formed in the same shape as the mast which is usually non-circular. The flange member has a triangular groove between the inner portion of the flange member and the mast. A triangular resilient member is placed in the triangular groove with the base portion protruding above the upper surface of the flange. A rigid cap ring is fastened to the flange and, with pressure, forces the triangular resilient member in the triangular groove thereby forming a watertight seal between the flange member and the mast.

24 Claims, 1 Drawing Sheet

SAILBOAT MAST DECK SEALING ASSEMBLY

BACKGROUND OF THE INVENTION

1. Field of the Invention

This invention relates to a sealing assembly to form a watertight seal between a sailboat mast and the boat deck.

2. Description of the Prior Art

It has been a long standing problem with sailboat owners with keel stepped mast to stop water leaking where the mast and the deck join. This leaking around the mast is an annoying and damaging problem.

Small sailboats usually use deck stepped masts and with the deck stepped mast the mast does not protrude through the deck. Since there is no hole in the deck, there is no leaking problem.

In keel stepped masts, which is usually designed in sailboats 30 feet or longer, the mast is secured to the keel of the boat and protrudes through the decking. The prior method of sealing the keel stepped masts is to provide a mast collar secured to the deck with a turned up ledge parallel to the mast. Wooden wedges are placed between the mast and the ledge of the collar to support the mast. The remaining space is filled with caulking compound and a canvass or rubber boot is placed over the mast and collar ledge. Large hose type clamps are then used to secure the boot to the collar ledge and the mast. Since the mast is not a round shape, hose clamps cannot distribute an even pressure around the entire circumference of the boot and therefore they do not seal correctly. The caulking compound becomes thinner when the temperature rises and usually drips down in the cabin area and creates a mess. Under the flexing and movement of the mast, the bond of the caulking compound, which relies on adhesion, breaks down and allows the water on the deck to leak into the cabin area.

An attempt has been made to solve this problem in U.S. Pat. No. 4,227,700 to Merry. Merry provides a metal collar and a resilient ring around the mast. Merry's metal collar inner surface and mast is parallel and the gap between the collar and mast is filled with a resilient material called a ring. He then attempts to keep the resilient ring tight in the gap by placing a resilient wedge or spline in a groove in the top of the resilient ring. Merry uses annular tangs to keep the wedge ring in the gap between the mast and the collar inner surface. The problem with this system is that under constant flexing and movement of the mast, the resilient wedge ring could work out of the gap and therefore the gasket would not seal and the system would leak. There is no positive means to keep the gasket in continuous bearing under pressure as in the present invention.

What is needed is a simple assembly that applies constant pressure on a resilient member in a wedge relationship such that an increase in force on the resilient member by a cap ring provides a tighter seal between the mast and the collar or flange member. In addition, the present invention provides a second embodiment with a flange member and cap ring that comes in two halves which can be used on an existing sailboat with a keel stepped mast and deck.

SUMMARY OF THE INVENTION

It is the object of the present invention to provide a sealing assembly with a resilient seal between a keel stepped mast and a deck of a sailboat.

It is another object of the present invention to provide a resilient member in a wedge relationship between the mast and a flange member surface to provide support for the mast.

It is yet another object of the present invention to provide a means for forcing the wedge shaped resilient member between the flange member and the mast.

It is still another object of the present invention to provide a flange member and a cap ring that can be made in two halves to fit a sealing assembly on an existing sailboat.

Briefly, in accordance with the present invention, there is provided a seal assembly that includes a rigid flange member formed in the same shape as the mast of a sailboat. The flange member is sealed and bolted to the deck completely encircling the mast. An annular surface is formed on the upper and inner portion of the flange member such that an angle is produced between the vertical mast and the surface of the flange member. A triangular resilient member is placed in the groove formed between the surface of the flange member and the mast such that the base protrudes above the upper surface of the flange member. A rigid cap ring is fastened, preferably by bolts, to the upper surface of the flange member whereby tightening the cap ring forces the resilient triangular member into the annular groove providing a watertight seal between the mast and the boat deck. In a second embodiment, the rigid flange member and rigid cap ring are both made in identical halves and the resilient triangular shaped member is a specific length with tapered ends where the resilient member is joined. The second embodiment allows a boat owner to utilize the present invention without having to remove the keel stepped mast. The present invention is simple, reliable and inexpensive to manufacture.

The novel features which are believed to be characteristic of the invention as to the system together with further objects and advantages thereof, will be better understood from the following description in connection with the accompanying drawings in which the presently preferred embodiments of the invention are illustrated by way of example. It is to be expressly understood, however, that the drawings are for purposes of illustration and description only, and are not intended as a definition of the limits of the invention.

These and other objects, features and advantages of the present invention will become more readily apparent upon detailed consideration of the following description of a preferred embodiment with reference to the accompanying drawings.

DETAILED DESCRIPTION OF THE INVENTION

Figure 1:
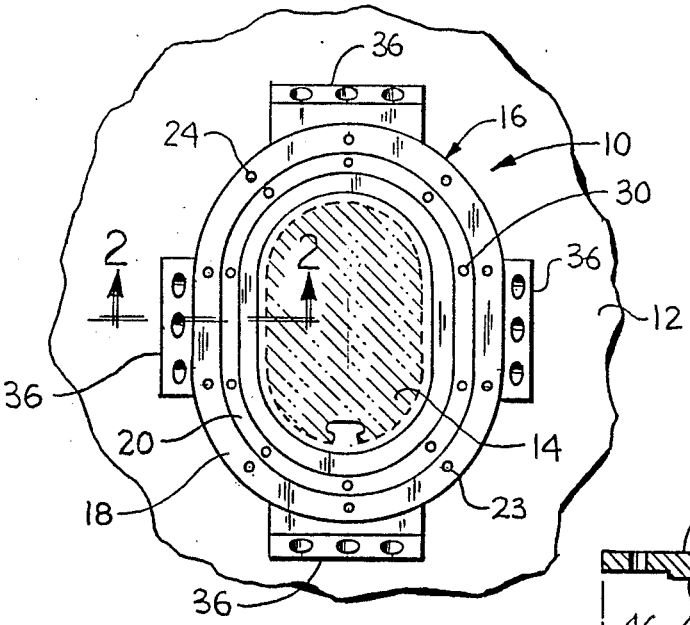
FIG. 1 is a top view of the sealing assembly without the resilient member.

Turning now to FIG. 1 there is shown the sealing assembly, generally shown at 10, mounted to a sailboat deck 12. The mast 14, shown in FIG. 1 as phantom lines, is attached to the sailboat keel (not shown). This type of arrangement is generally known as a "keel stepped" mast. A keel stepped arrangement is generally used in larger sailboats which are usually at least 30 feet in length. However, if increased strength is desired, the keel stepped mast can be used on any length. The other type of mast attachment is a "desk stepped" which is attached to the top surface of the sailboat deck and does not go through the deck. It should be noted that mast 14 is not circular but elliptically shaped which is the normal shape for larger masts. The major axis of the elliptically shaped mast is mounted fore and aft on the sailboat. This mounting allows for greater strength in the fore and aft direction.

Figure 2:
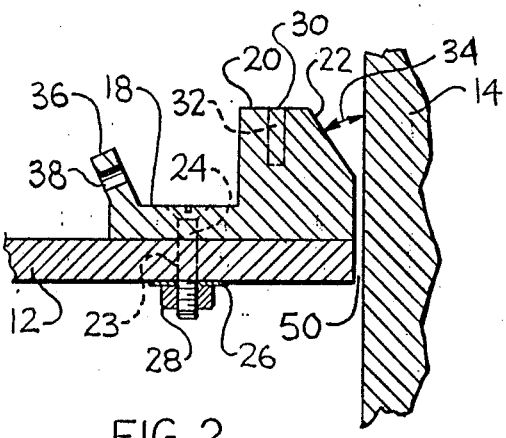
FIG. 2—2 is a section view through the sealing assembly and part of the mast.

A rigid flange member 16, which is the basic part of the sealing assembly, contains three primary elements that completely encircle the mast 14. These three elements are a fastening portion 18, a ridge portion 20 and a sealing surface 22. The fastening portion contains evenly spaced holes 23 to receive a fastening means 24 (as shown in FIG. 2—2). Fastening means 24 is preferably a bolt that passes through the deck 12 and is fastened on the bottom of the deck by a washer 26 and nut 28 (shown in FIG. 2—2). The rigid flange member 16 may be sealed to the deck by various types of sealing means such as "permatex" or "silicone", however the preferred embodiment in the present invention is a rubber gasket (not shown).

The ridge portion 20 also contains evenly spaced holes that are drilled and tapped to receive fastening means. The flat sealing surface 22 forms an angle 34 between the vertical mast 14 and the ridge portion 20. This angle 34 creates a "V" shaped cavity or groove completely encircling the mast. The angle between the vertical mast 14 and the sealing surface 22 in the preferred embodiment is 40 degrees ±2 degrees which will provide the best sealing assembly when a resilient member is compressed in the "V" shaped cavity.

FIG. 2—2 shows a cross section of the rigid flange member 16 bolted to deck 12 with fastening means 24 having a washer 26 and nut 28 secured on the bottom side of the deck 12.

Also shown in FIG. 2—2 is a cross section of the holes 30, on the ridge portion 20, which have been drilled and tapped with internal threads 32 therein. Also shown in FIG. 2—2 is the angle 34 formed between the vertical mast 14 and the sealing surface 22. FIG. 2—2 also shows ears 36 which are attached to flange member 16. These ears 36 have holes 38 therethrough to accommodate blocks or halyards or the like.

Figure 3:
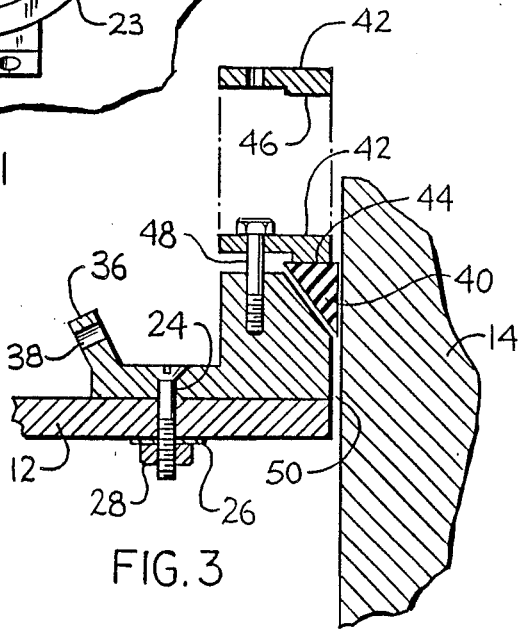
FIG. 3 is a section view which is the same as FIG. 2—2 but with the addition of the resilient member and the cap ring.

FIG. 3 shows the same cross section as FIG. 2—2 with the addition of a triangular shaped resilient member 40 and a cap ring 42 both completely encircling mast 14. As can be seen, the base 44 of the triangular resilient member 40 protrudes above the ridge portion 20. In addition, the cap ring 42 has a ridge 46 formed in the bottom to exert an even pressure on the base 44 of resilient member 40. Since the resilient triangular member 40 has a base 44 that protrudes slightly upward and the cap ring 42 has a ridge 46 that comes in contact with the base 44 of resilient member 40, fastening means 48 which are threaded into evenly spaced holes 30 can be torqued only until the resilient member 40 forms an adequate seal against the mast 14. Fastening means 48 do not have to be torqued until the bottom of the cap ring 42 touches the top of ridge member 20. In this manner, periodic torquing of fastening means 48 can compensate for the wear of resilient seal 40 in addition to the aging of the resilient member 40. The triangular resilient member may be formed from various resilient materials, however, in the preferred embodiment, the triangular resilient member is formed from rubber. It should be noted in FIGS. 2—2 and 3 that a gap 50 exists between the rigid flange member 16 and the mast 14. This gap is at least ⅛ of an inch in the preferred embodiment. It should also be noted that the resilient member 40 provides even pressure and support to the entire outside surface of mast 14 which is clearly superior over the prior art that uses wooden wedges at intervals around the mast for support. The above embodiment description assumes that the flange assembly 10 is installed as a sailboat is being constructed.

Figure 4:
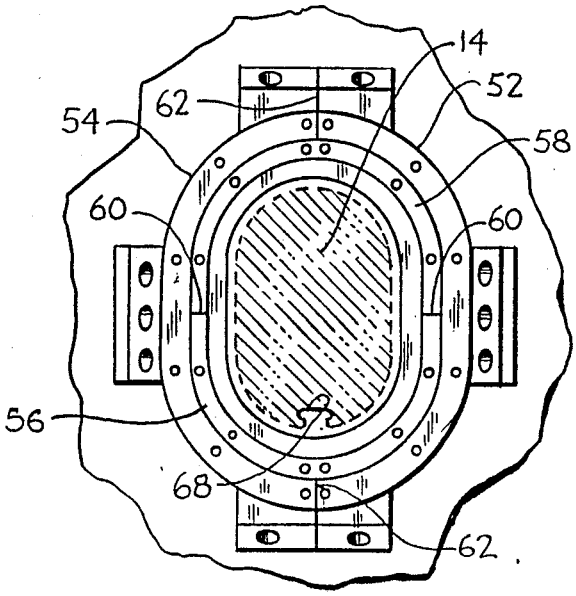
FIG. 4 is a top view of the embodiment that provides the flange member in two identical halves and the cap ring in two identical halves.
Figure 5:
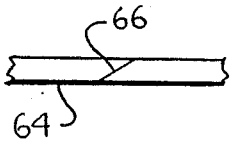
FIG. 5 shows the splice of the resilient member when used with the embodiment shown in FIG. 4.

A second embodiment shown in FIG. 4 is designed for the boat owner who desires to convert a prior art sealing means on an existing boat to the present invention with its superior features. FIG. 4 is the same basic configuration as FIG. 1 except that rigid flange member 16 is fabricated in two halves 52 and 54. These two halves 52 and 54 are sealed and secured to the deck 12 just as previously described for the embodiment 10 in FIG. 1. A sealing material such as "permatex" (not shown) that will not harden with age can be applied to the ends of flange members 52 and 54 for increased sealing integrity. Also shown in FIG. 4, in place, is cap ring members 56 and 58. The cap ring is the same basic configuration as shown in FIG. 3 except the cap ring is fabricated in two halves 56 and 58. It is noted in FIG. 4 that the cap ring members 56 and 58 are fabricated to be placed on the flange members 52 and 54 such that the abutting of the ends 60 of cap ring members 56 and 58 are placed 90 degrees to the abutting of the ends 62 of flange members 52 and 54. This configuration provides additional strength and better sealing of the embodiment shown in FIG. 4. Turning now to FIG. 5 there is seen the inside edge of a portion of resilient member 64 that will be used with the configuration presented in FIG. 4. The resilient member 64 will be of sufficient length to fit in the "V" shaped cavity formed by the flange members 52 and 54 and mast 14. In order to form a seal when compressed, the ends of resilient member 64 will be cut at an angle as shown by 66 when the ends of resilient member 64 abut. In the preferred embodiment, an angle of approximately 30 degrees will provide sufficient contact area at 66 to provide a good seal when compressed. There is seen on mast 14 in both FIGS. 1 and 4 a groove 68 that is called a mainsail track. Nylon members called "cars" are attached to the edge of the mainsail and the cars travel up and down the mainsail track. It is easier and simpler for the mast manufacture to form the mainsail track at the point where the mast 14 enters the deck 12. Since the mainsail track or groove 68 is not used at this juncture, the present invention requires the groove 68 be filled with an epoxy type material (not shown) which will age harden. This material must then be smoothed to the same shape as the mast 14 at the place where the resilient member 40 will be forced against the mast 14 to form a watertight seal.

Thus, it is apparent that there has been provided in accordance with the invention, a sailboat mast deck sealing assembly that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit and scope of the appended claims.

What is claimed is:

1. A sailboat having a deck and a mast with a sealing assembly between the deck and mast comprising:

a rigid flange member having a center opening formed in the same shape as said mast, said flange member also having an upper surface, a lower surface, an outer surface and an inner surface, said inner surface having an upper and lower edge, said inner surface also encircling and being adjacent to said mast;

a rubber gasket placed between said flange member and said deck for sealing said flange member to said deck;

means for securing said flange to said deck;

a triangular shaped annular groove formed by removing said inner surface upper edge to provide a flat sealing surface where said flat sealing surface forms an angle between said mast and said flange member;

a triangular shaped resilient annular member, having a base, formed to fit in said triangular shaped annular groove;

means for compressing said resilient triangular shaped annular member in said triangular shaped annular groove to form a watertight seal between said flat sealing surface and said mast.

2. A sealing assembly as described in claim 1 wherein said means for securing said flange member to said deck is by bolts placed through evenly spaced holes in said flange member and through said deck.

3. A sealing assembly as described in claim 2 wherein said bolts for fastening said flange member to said deck are non-corrosive bolts placed through said evenly spaced holes of said flange member and through said deck, said bolts having a washer and nut fitted and tightened thereon.

4. A sealing assembly as described in claim 1 wherein the angle between said mast and flat sealing surface is 40 degrees ±2 degrees.

5. A sealing assembly as described in claim 1 wherein said upper surface of said flange member contains evenly spaced threaded holes.

6. A sealing assembly as described in claim 1 wherein said base of said triangular shaped resilient annular member, when placed in said triangular shaped annular groove, protrudes above the upper surface of said flange member.

7. A sealing assembly as described in claim 6 wherein said means for compressing said resilient triangular shaped annular member in said triangular annular groove is by a rigid cap ring encircling said mast and pressing against said base of said triangular shaped resilient annular member that protrudes above the upper surface of said flange member.

8. A sealing assembly as described in claim 7 wherein said cap ring contains evenly spaced holes therethrough in alignment with said evenly spaced threaded holes in said flange member.

9. A sealing assembly as described in claim 7 wherein said cap ring is secured to said flange member by non-corrosive threaded fastening means through evenly spaced holes in said cap ring and threaded into evenly spaced holes in said upper surface of said flange member whereby evenly torqueing said fastening means compresses said triangular shaped resilient member between said mast and said flat sealing surface, formed on said flange member, to provide a watertight seal.

10. A sealing assembly as described in claim 7 wherein said rigid cap ring is formed from a non-corrosive material.

11. A sealing assembly as described in claim 7 wherein said cap ring is formed in two identical halves which encircles said mast, said cap ring containing evenly spaced holes therethrough in alignment with said evenly spaced threaded holes in said flange member, said cap ring being secured to said flange member by fastening means such that the ends of the two identical halves abutt and the abutted ends of said cap ring is 90 degrees to the abutted end of said flange member.

12. A sealing assembly as described in claim 11 wherein evenly torqueing said fastening means compresses said triangular shaped resilient member against said mast to form a watertight seal.

13. A sealing assembly as described in claim 1 wherein a gap is provided between said inner surface of said flange member and said mast.

14. A sealing assembly as described in claim 1 wherein compressing said triangular shaped member against said mast and said flat sealing surface formed on said flange member provides support for said mast.

15. A sealing assembly as described in claim 1 wherein said flange member contains ear members with holes therethrough.

16. A sealing assembly as described in claim 1 wherein said mast is a keel stepped mast.

17. A sealing assembly as described in claim 1 wherein said triangular shaped resilient member is formed from a rubber material.

18. A sealing assembly as described in claim 1 wherein said rigid flange member is formed from a non-corrosive material.

19. A sealing assembly as described in claim 1 wherein said flange member is formed in two identical halves, said flange member having evenly spaced threaded holes, said flange member being placed around said mast with securing and sealing means to said deck such that the ends of the two identical halves abutt.

20. A sealing assembly as described in claim 1 wherein said triangular shaped resilient member, having two ends, and is of sufficient length to form an annular seal in said triangular shaped annular groove, the ends of said resilient member being cut at an angle sufficient to form sealing means between said mast and said flat sealing surface on said flange member.

21. A sealing assembly as described in claim 1 wherein a mainsail track on said mast is filled with a hardening epoxy material at the juncture of said deck and said mast.

22. A sealing assembly as described in claim 21 wherein said epoxy material is smoothed such that the epoxy material surface will conform to the surface of said mast.

23. A method of sealing between a keel stepped mast and the deck of a sail boat comprising:

providing a flange member having a flat sealing surface adjacent to said mast which forms a triangular groove;

sealing and securing said flange member to said deck such that said flange member encircles said mast;

providing a triangular resilient member to be placed in said triangular groove of said flange member, said base of said triangular resilient member protruding above said flange member;

providing a cap ring having means to compress said resilient member;

securing said cap ring to said flange member by fastening means whereby evenly torqueing said fastening means compresses said triangular shaped resilient member between said mast and said flat sealing surface to form a watertight seal.

24. A method of sealing between a keel stepped mast and the deck of a sailboat as described in claim 23 wherein said flange member contains ear members with holes therethrough.

* * * * *